US005091028A

United States Patent [19]

Yamazaki et al.

[11] Patent Number: 5,091,028

[45] Date of Patent: Feb. 25, 1992

[54] METHOD FOR MANUFACTURING A HEAT RESISTANT VOICE COIL

[75] Inventors: Yuzo Yamazaki, Komoro; Toshiro Nishizawa, Ueda, both of Japan

[73] Assignee: Totoku Electric Co., Ltd., Tokyo, Japan

[21] Appl. No.: 358,452

[22] Filed: May 30, 1989

Related U.S. Application Data

[63] Continuation of Ser. No. 845,446, Mar. 28, 1986, abandoned.

[30] Foreign Application Priority Data

Mar. 30, 1985 [JP] Japan ..... 60-67347

[51] Int. Cl.[5] ..... H01F 3/06; B65H 81/00

[52] U.S. Cl. ..... 156/172; 156/169; 156/325; 156/331.1; 29/606; 29/609.1; 427/116; 427/120; 381/194

[58] Field of Search ..... 381/194, 195, 185; 29/602 R, 602 A, 605, 606, 609.1; 156/331.1, 169, 325, 172; 524/726; 427/116–118, 120; 181/167–170

[56] References Cited

U.S. PATENT DOCUMENTS

| | | | |
|---|---|---|---|
| 3,006,899 | 10/1961 | Hill, Jr. et al. | 264/210.8 X |
| 3,179,614 | 4/1965 | Edwards | 357/72 X |
| 3,444,183 | 5/1969 | Hubbuch | 524/233 |
| 3,492,270 | 1/1970 | Parish | 524/726 |
| 3,906,139 | 9/1975 | Hiraoka et al. | 427/118 X |
| 3,926,760 | 12/1975 | Allen et al. | 204/181.6 X |
| 4,467,011 | 8/1984 | Brooks et al. | 428/245 |

FOREIGN PATENT DOCUMENTS

| | | | |
|---|---|---|---|
| 0210097 | 10/1985 | Japan | 29/609.1 |
| 0210098 | 10/1985 | Japan | 29/609.1 |

OTHER PUBLICATIONS

"Nomenclature for the Adhesives Industry", Nov. 23, 1959.

*Primary Examiner*—Michael W. Ball
*Assistant Examiner*—Jeff H. Aftergut
*Attorney, Agent, or Firm*—Oblon, Spivak, McClelland, Maier & Neustadt

[57] ABSTRACT

This invention provides a heat-resistant voice coil of H class in heat-resistance standard, which is characterized in that an electrically insulated adhesive paint applied onto both a bobbin and conductor wire is mainly consisted of a mixture comprising all aromatic polyamide resin and a hardening agent composed of aromatic polyamic acid. This invention further provides a method of manufacturing such a heat-resistant voice coil, wherein the conductor wire coated with the paint is wound around the bobbin preliminarily coated with the paint in a semihardened state, while applying a non-water polar solvent onto the bobbin.

3 Claims, 1 Drawing Sheet

METHOD FOR MANUFACTURING A HEAT RESISTANT VOICE COIL

This application is a continuation of application Ser. No. 06/845,446, filed on Mar. 28, 1986, now abandoned.

BACKGROUND OF THE INVENTION (a) Field of the Invention

This invention relates to a voice coil used with the speaker of acoustic apparatus such as a stereophonic device, and more particularly to a voice coil whose heat-resistant region has excellent thermal resistivity corresponding to the so-called H type.

(b) Description of the Prior Art

The voice coil is fabricated by applying a solvent to a self-fusible electrically insulated wire which is coated with baked adhesive paint with an insulating membrane interposed therebetween and regularly winding said wire around a paper tube (or a bobbin) covered with an adhesive layer, and laminating a plurality of said coil plies on each other.

As compared with other electric signal-voice conversion devices, the conventional voice coil has a far lower capacity to convert an input electric signal into a voice (realized by the mechanical vibrations of conical paper). The loss of an electric signal leads to the generation of heat, and consequently the temperature rise of the voice coil. Therefore, the voice coil tends to indicate a higher temperature as it is designed to be more reduced in size and produce a higher output. It is not rare that the voice coil reaches as high a temperature as 450° to 500° C., though for a short interval. The mechanical and thermal destruction of the voice coil first arises between the paper tube and surrounding wire coils, and then most prominently in the adhered interfaces between the wire coil plies as well as between the adhered turns of the respective coils. The main reason for this undesirable event is that (1) strains arise between the paper tube and surrounding wire coils because they have different thermal expansion coefficients; and (2) displacement occurs between the paper tube and surrounding wire coils due to the vibration of the voice coil assembly and the heat release of the wire coils. In the worst case, the wire coils are taken off the paper tube, thus resulting in the loss of the function of a voice coil.

With the conventional voice coil, however, a low boiling alcoholic solvent was applied for the dissolution of the adhesive layer coated on the self-fusible electrically insulated wires. Therefore, the main component of adhesive paint was necessarily limited to a synthetic resin having an aliphatic main chain, for example, a resin of the polyvinyl butyral series or alcohol-soluble polyamide series. Hitherto, therefore, there has been obtained only A or E class in heat resistance criterion which has a low heat resistance.

Recently a high output and high performance are demanded of acoustic apparatuses such as a stereoacoustic device. Consequently, the speaker used with said device undergoes a more rigid load, and a voice coil applied to the speaker is inevitably required to have prominent resistance to vibrations and heat. To meet the above-mentioned requirements, an adhesive paint prepared by blending various curing agents with an alcohol-soluble polyamide resin (the main component of the thermoplastic adhesive) has been applied to the self-fusible electrically insulated wire and paper tube.

To-date, however, no voice coil has been proposed which fully satisfies the thermal properties.

With the conventional voice coils, the adhesive applied to the self-fusible electrically insulating wire and paper tube is mainly prepared, as mentioned above, from a synthetic resin containing a main chain of aliphatic series. The voice coil has been fabricated by solving and swelling the adhesive layer by means of a solvent of alcoholic series. Consequently it has been impossible to fabricate a superbly heat resistant voice coil whose heat-resistant is represented by the H class regarded as indispensable to a compact high output speaker.

SUMMARY OF THE INVENTION

It is accordingly the object of this invention to fabricate a superbly heat-resistant voice coil whose heat-resistant criterion is represented by the H class and which possesses great mechanical properties, and also to provide a method of manufacturing the same.

The present inventors have carried out research work on the composition of a resin constituting the aforementioned adhesive and also on a solvent which ensures the dissolution and swelling of said adhesive paint. As a result, it has been discovered that the maintenance of the thermal and mechanical properties of a voice coil, even when prominently raised in temperature, can be realized by applying an adhesive paint which is prepared from a polymer of aromatic heterocyclic structure, is soluble in an organic solvent, is possessed of a relatively simple physical structure, and enables the resultant adhesive paint to be swollen and redissolved by means of an organic solvent. The present inventors further studied the optimum method of fabricating a heat-resistance adhesive membrane which sufficiently meets the above-mentioned requirements. As a result, it has been proved that it is very effective to mix all-aromatic polyamide resin with an aromatic polyamic acid as a thermosetting component, dissolve the mixture in a polar non-water solvent and apply the resultant adhesive paint which is subsequently dried in a semi-hardened state.

Namely, a voice coil embodying this invention is fabricated by winding a bobbin with a conductor coated with electrically insulated adhesive paint. In this case, said bobbin is previously coated with the same kind of electrically insulated adhesive paint as the aforesaid paint. Namely, the voice coil of the present invention is characterized in that the aforementioned electrically insulated adhesive paint is prepared by adding a hardening agent prepared from aromatic polyamic acid having the undermentioned general structural formula and later hardening the mixture

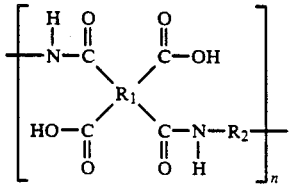

where:

$R_1$ is an aromatic cycle selected from the group consisting of:

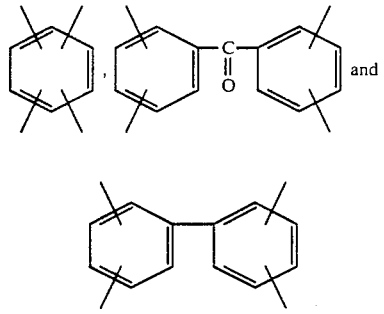

$R_2$ is an aromatic cycle selected from the group consisting of:

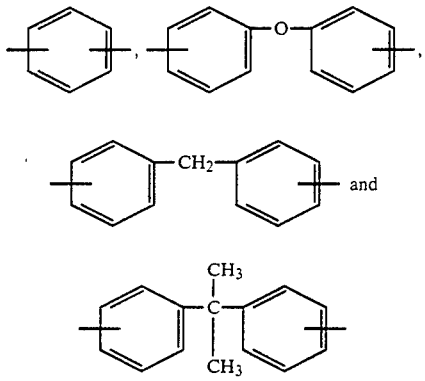

and n is an integer of 1 or more.

Further, the present invention provides a method of manufacturing a voice coil which comprises the steps of:

dissolving all aromatic polyamide resin and aromatic polyamic acid indicated by the undermentioned general structural formula in a polar non-water solvent;

applying said paint to the surface of an insulation layer-coated conductor and later drying said paint into a semi-hardened state, thereby fabricating a self-fusible electrically insulated conductor;

closely winding said paint-covered conductor about the outer periphery of said bobbin coated preliminarily with said thermosetting resinous adhesive paint in a semihardened sate while applying polar non-water solvent; and thermally hardening said thermosetting resinous adhesive paint;

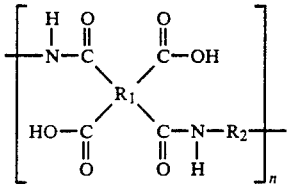

$R_1$ is an aromatic cycle selected from the group consisting of:

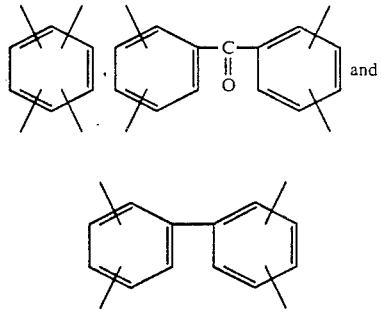

$R_2$ is an aromatic cycle selected from the group consisting of:

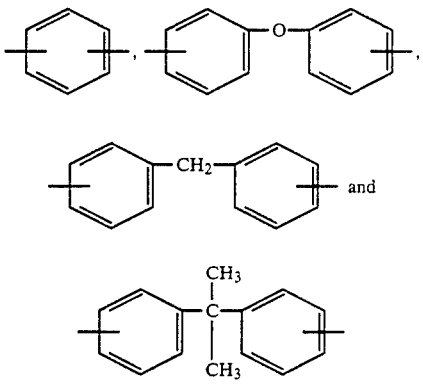

and n is an integer of 1 or more.

DESCRIPTION OF THE PREFERRED EMBODIMENT

A concrete example of an all aromatic polyamide resin applied in the present invention may be represented by an all aromatic polyamide resin obtained by a dechlorination reaction between aromatic dicarboxylate dichloride and aromatic diamine

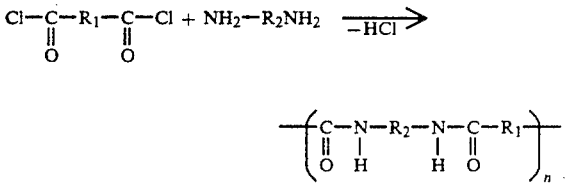

where:

$R_1$ is an aromatic cycle selected from the group consisting of:

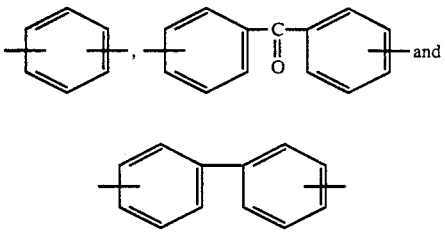

$R_2$ is an aromatic cycle selected from the group consisting of:

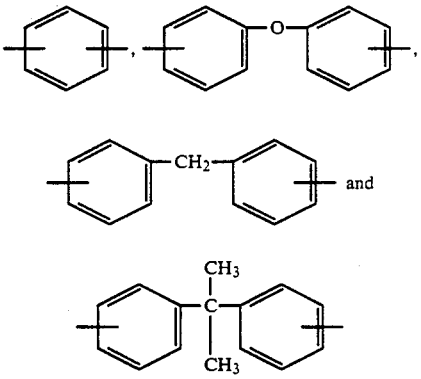

and n is an integer of 1 or more.

Aromatic polyamic acid acting as a thermosetting component may be indicated by the undermentioned general structural formula

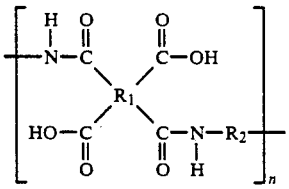

where:

$R_1$ is an aromatic cycle selected from the group consisting of:

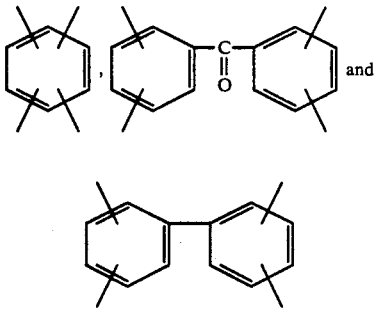

$R_2$ is an aromatic cycle selected from the group consisting of:

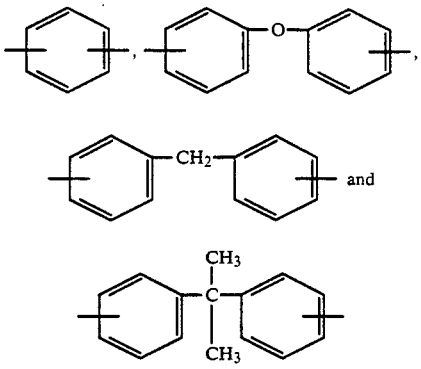

and n is an integer of 1 or more.

The above-mentioned aromatic polyamic acid should be added to said all aromatic polyamide resin at the rate of 33 to 300 parts by weight or preferably 75 to 200 parts by weight on the basis of 100 parts by weight of said all aromatic polyamide resin.

An organic solvent to dissolve said polyamide resin and polyamic acid involves, for example, a polar non-water solvent such as dimethyl acetamide (DMAc), dimethylformamide (DMF) and N-methylpyrrolidone.

The bobbin-supporting conducting coils may be prepared from synthetic paper (Normex) of all aromatic polyamide series which has excellent heat resistance and indicates small dimensional change during heat treatment, unwoven fabric of glass impregnated with polyimide, unwoven fabric composed of all aromatic polyamide fiber and glass fiber, composite synthetic paper prepared from all aromatic polyamide fiber and short fibers of various ceramic sources, and also from metal foils.

Figure 1:
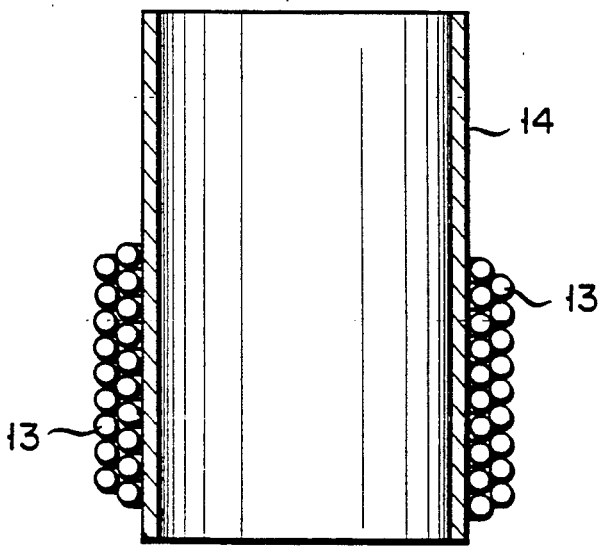
FIG. 1 is a cross-sectional view of a voice coil according to one embodiment of the present invention.
Figure 2:
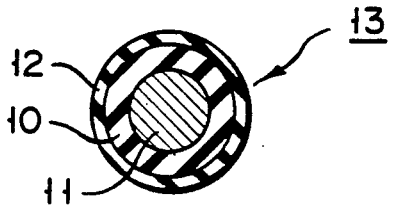
FIG. 2 is a cross-sectional view of a conductor wire to be wound about the outer surface of a bobbin of the voice coil.

The voice coil embodying this invention is manufactured by the following steps. First, the aforementioned all aromatic polyamide resin and aromatic polyamic acid are dissolved in polar non-water solvent to provide thermosetting resinous adhesive paint 12. As shown in FIG. 2, said thermosetting resinous adhesive paint 12 is coated on conductive wire 11 (formed of, for example, copper or aluminium) which is previously covered with insulating layer 10 (prepared from, for example, polyimide series resin) and then is thermally dried into a semihardened state. Self-fusible electrically insulated conductive wire 13 thus fabricated is tightly wound about part of the outer periphery of bobbin 14 (FIG. 1).

In this case, the required portions of the outer peripheral surface of bobbin 14 are previously coated with a thermosetting resinous adhesive prepared, as previously mentioned, by dissolving the all aromatic polyamide resin and aromatic polyamic acid in a polar non-water solvent. Said coated adhesive is dried into a semihardened state. Aforementioned self-fusible conductive wire 13 is tightly wound about bobbin 14 while said polar non-water solvent is once more applied to effect the dissolution and swelling of the semihardened adhesive paint. After conductive wire 13 is wound about bobbin 14, thermal hardening is applied to effect integral fusion between bobbin 14 and coiled conductive wire 13, thereby providing a tightly adhered membrane.

A membrane obtained by the application and drying of an adhesive paint prepared according to the present invention from all aromatic polyamide resin and aromatic polyamic acid acting as a component resistive to thermal hardening has a great mechanical strength even in a semi-hardened state and fully withstands a tensile strength applied to conductive wire 13 when coiled about bobbin 14 and also abrasion occurring between wire 13 and pulley. Further, the adhesive reactivated by the polar non-water solvent has a prominent head resistant adhesivity. The above-mentioned advantages are derived from the facts that the all aromatic polyamide resin has an excellent film-forming property; the film has a small friction coefficient and a prominent slipperiness; and the aromatic polyamic acid is readily dissolved in a polar non-water solvent, while remaining in the state of amic acid, indicates a good phase solubility with all aromatic polyamide resin, and is easily converted into imide by heat treatment at a relatively low temperature, thus indicating the original heat-resistant property of polyimide resin.

This invention will become more apparent with reference to the following examples.

EXAMPLE 1

Preparation of all Aromatic Polyamide Resin poly-m-phenyleneisophthalamide

A flask of 2,000 ml was fitted with a stirrer, thermometer and pipette. 32.4 g (0.3 mol) of m-phenylenediamine and 24.0 g (0.6 mol) were dissolved in 750 mol of water. While the aqueous solution was fully being stirred, 300 ml of cyclohexanone containing 63.9 g of isophthalic chloride (0.315 mol) was dripped into said aqueous solution within 5 minutes. One hour after the stirring, a large amount of polymer suspension was poured into acetone. The polymer was filtered out through a glass filter. The filtered polymer was repeatedly washed with acetone and hot water. After the washing was brought to an end, the polymer was naturally dried, providing 70 g of poly-m-isophthalamide resin. This polymer indicated intrinsic viscosity ranging between 0.8 and 1.0 g/dl in 96% sulfuric acid. 70 g of the polymer was dissolved in 630 g of dimethylacetamide, thus providing a solution of 10% concentration.

EXAMPLE 2

Preparation of Aromatic Pyromellitimide Acid

A separable flask of 2,500 ml was provided which was fitted with a stirrer, nitrogen inlet pipe and drying pipe. While nitrogen gas was let to pass through the flask in a sufficiently dried state to render the interior of the flask completely free from water 100 g (0.5 mol) of bit (4-aminophenyl) ether was weighed into the flask. Then 1,881 g of dimethylacetamide was added to dissolve the ether. While the solution was vigorously stirred, 109.0 g (0.5 mol) of anhydrous pyromellitic acid was poured in 2 to 3 minutes. With the addition of the anhydrous acid, the reactants rose in temperature up to about 40° C., but soon cooled to room temperature. Later, stirring was continued for one hour at room temperature, providing 2,090 g of 10% solution of aromatic pyromellitimide having an intrinsic viscosity of 1.5 to 3.0 g/dl (0.5% DMAc solution 30° C.).

Manufacture of Heat-Resistant Voice Coil (1) Preparation of heat resistant adhesive paint:

An aromatic polyamide resin obtained in Example 1 was mixed with a thermosetting component represented by the aromatic polyamic acid prepared in Example 2, thus providing a heat-resistant adhesive paint having the composition shown in Table 1 below.

TABLE 1

Composition of heat-resistant adhesive paint

| Composition | Sample 1 | Sample 2 |
|---|---|---|
| 10% DMAc solution of all aromatic polyamide | 300 g | 600 g |
| 10% DMAc solution of aromatic polyamic acid | 300 g | 300 g |

(2) Fabrication of bobbin material:

Heat-resistant adhesive having the composition shown in Table 1 above was applied to a thickness of 0.010 mm on the surface of a polyimide glass cloth having a thickness of 0.07 mm by means of a bar coater. The mass was held in a thermostat at 120° C. for 5 minutes, thereby producing two types (samples 1-A and 2-A) of bobbin material respectively containing a semi-hardened adhesive paint.

(3) Fabrication of self-fusible electrically insulated wire:

A copper wire having a diameter of 0.26 mm was coated with polyamidimide insulating paint to such an extent that the finished wire had an outer diameter of 0.280 to 0.285 mm. The paint was later baked. The insulated conductor thus produced was coated with a heat-resistant adhesive paint having a composition shown in Table 1 above to a uniform thickness of 5 microns. The paint was dissolved in a polar non-water solvent, and then baked to a semihardened state so as to effect reactivation, thus producing two types (samples 1-B and 2-B) of self-fusible electrically insulated wire.

(4) Manufacture of heat-resistant voice coil:

Two type (sample 1-A and 2-A) of bobbin material produced by the above-mentioned steps were respectively cut up in the form of a strip measuring 25 mm in width and 76 mm in length. The samples were herically taken up on a jig with the adhesive-bearing plane kept outward. Dimethylacetamide solvent was applied to the surface of two types of self-fusible electrically insulated wires (samples 1-B and 2-B) which were contained in the four assemblies indicated in Table 2 below. First assembly 1 consisted of bobbin material (sample 1-A) and self-fusible electrically insulated wire (sample 1-B). Second assembly 2 was composed of bobbin material (sample 1-A) and self-fusible electrically insulated wire (sample 2-B). Third assembly 3 was comprised of bobbin material (sample 2-A) and self-fusible electrically insulated wire (sample 1-B). Fourth assembly 4 consisted of bobbin material (sample 2-A) and self-fusible electrically insulated wire (sample 2-B). Dimethylacetamide solvent was applied on all the abovementioned four assemblies to effect the swelling and dissolution of the adhesive layer coated on the wires. The bobbin material was wound with two plies of the insulated wire coils having a total number of 106 turns.

TABLE 2

Composition of Voice Coil

| | Assembly 1 | Assembly 2 | Assembly 3 | Assembly 4 |
|---|---|---|---|---|
| Bobbin material | Sample 1-A | Sample 1-A | Sample 2-A | Sample 2-A |
| Self-fusible electrically insulated wire | Sample 1-B | Sample 2-B | Sample 1-B | Sample 2-B |

After the wound wire was removed from the winding jig, the voice coil was preliminarily dried in a thermostat at 120° C. for 15 minutes. While being still fitted to the winding jig. Later, the whole mass was heat treated in a thermostat at 230° C. for 30 minutes, thereby fully hardening the semihardened adhesive layer interposed between the respective turns as well as between the coils and paper tube. Thus was prepared a prominently heat-resistant voice coil embodying this invention.

Determination was made of the adhesivity of the paint at room temperature and after the possible thermal deterioration in order to check the heat-resistant property of the subject voice coil. Test was made of the adhesivity between the turns of the first coil ply and those of the second coil ply as well as the adhesivity between the first coil ply and the surface of the paper tube. The adhesivity was tested by the process of inserting a voice coil having a calibre of 25 mm into a cylindrical voice coil-measuring jig on both sides of which bearings were embedded. The end of the wire coil was connected to a strain gauge. The measuring jig was pulled to determine the adhesivity of the paint applied. The adhesivity of the paint after the thermal deterioration was determined by purposely deteriorating said adhesivity by holding the voice coil in the thermostats respectively kept at 200° C., 250° C. and 300° C. for 24 hours. Thereafter the adhesivity was determined by a tensile strength tester equipped with a thermostat in an atmosphere kept at 180° C., the results being set forth in Table 3 below.

TABLE 3

Adhesivity of Voice Coil

| | EXAMPLES | | | | | | | | Unit: g | |
|---|---|---|---|---|---|---|---|---|---|---|
| | 1 | | 2 | | 3 | | 4 | | Contol | |
| Thermal | Wire to wire | Wire to bobbin | Wire to wire | Wire to bobbin | Wire to wire | Wire to bobbin | Wire to wire | Wire to bobbin | Wire to wire | Wire to bobbin |
| | Room Temperature | | | | | | | | | |
| determination | 110 | 105 | 110 | 105 | 95 | 80 | 95 | 80 | 120 | 115 |
| 200° C. | 95 | 100 | 95 | 95 | 85 | 70 | 85 | 80 | 40 | 50 |
| 250° C. | 75 | 70 | 75 | 70 | 70 | 65 | 75 | 70 | 30 | 30 |
| 300° C. | 50 | 45 | 50 | 45 | 40 | 40 | 40 | 40 | 0 | 0 |

The voice coil manufactured by the method of this invention is characterized in that the adhesive paint applied to the peripheral surface of the bobbin and the self-fusible electrically insulated wire is prepared from heat-resistant resin mainly composed of all aromatic polyamide resin and heterocyclic oligomer; the composite adhesive layer indicates prominent heat resistance and mechanical strength due to the combined chemical properties of both resins; the subject voice coil shows sufficient heat resistance even when the coil temperature increases about 100 degrees higher than that of the conventional voice coil, and allows for the input of about 30% more power than possible with the conventional voice coil.

What is claimed is:

1. A method of manufacturing a voice coil which comprises the steps of:

dissolving all aromatic polyamide resin and aromatic polyamic acid having a general structural formula given below in a polar non-water solvent to provide a thermosetting resinous adhesive paint:

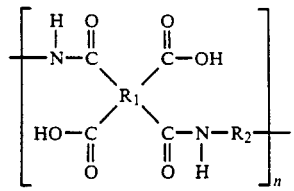

where:

$R_1$ is an aromatic cycle selected from the group consisting of:

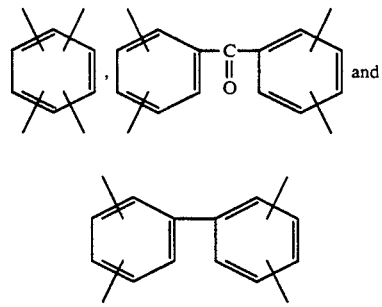

$R_2$ is an aromatic cycle selected from the group consisting of:

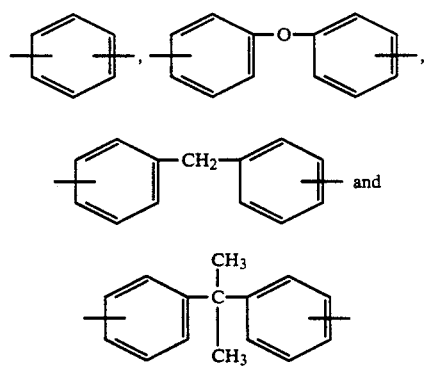

and n is an integer of 1 or more, producing a self-fusible electrically insulated paint-covered conductive wire by applying said paint on a surface of an insulation layer-coated conductive wire and drying said paint to a semihardened state;

applying said paint on a surface of a bobbin and drying said paint to a semihardened sate;

tightly winding said paint-covered conductive wire about a peripheral surface of the bobbin covered with said thermosetting resinous adhesive paint, while applying a polar non-water solvent to swell said paint of a semihardened state; and thermally hardening said thermosetting resinous adhesive paint of semihardened state.

2. The method of manufacturing a voice coil according to claim 1, wherein said polar non-water solvent is selected from the group consisting of dimethyl acetamide, dimethyl formamide and N-methyl pyrolidone.

3. The method of manufacturing a voice coil according to claim 1, wherein said hardening agent is added to said all aromatic polyamide resin at a rate of 33 to 300% by weight on a basis of said polyamide resin.

* * * * *